US010851583B2

(12) United States Patent
Ezra

(10) Patent No.: US 10,851,583 B2
(45) Date of Patent: Dec. 1, 2020

(54) ACCESSORY FOR PREVENTING A PRE-HUNG DOOR FROM SAGGING IN A DOOR FRAME

(71) Applicant: Isaac Ben Ezra, West Bloomfield, MI (US)

(72) Inventor: Isaac Ben Ezra, West Bloomfield, MI (US)

( * ) Notice: Subject to any disclaimer, the term of this patent is extended or adjusted under 35 U.S.C. 154(b) by 0 days.

(21) Appl. No.: 14/756,287

(22) Filed: Aug. 21, 2015

(65) Prior Publication Data

US 2017/0298684 A1 Oct. 19, 2017

(51) Int. Cl.
*E06B 1/00* (2006.01)
*E06B 7/28* (2006.01)

(52) U.S. Cl.
CPC ..... *E06B 7/28* (2013.01)

(58) Field of Classification Search
CPC ..... E06B 7/28
USPC ..... 49/380; 206/325
See application file for complete search history.

(56) References Cited

U.S. PATENT DOCUMENTS 3,593,458 A * 7/1971 Wahlfeld ..... E06B 7/00 206/325
D319,007 S * 8/1991 Rogers ..... D8/400
5,159,782 A * 11/1992 Sales ..... E05B 17/0012 206/325
5,562,315 A * 10/1996 Sales ..... E05C 1/04 292/150
5,722,203 A * 3/1998 Staples ..... E06B 7/00 49/380
5,787,639 A * 8/1998 Lamore, Jr. ..... E05B 17/0012 49/380
5,991,984 A * 11/1999 Schaty ..... F16B 13/0808 24/609
6,170,198 B1 * 1/2001 Staples ..... E06B 7/00 49/380
7,118,143 B2 * 10/2006 L'Heureux ..... E05B 17/0012 292/175
8,245,448 B2 * 8/2012 Crane ..... E05B 17/0012 206/325
8,959,730 B2 * 2/2015 Hemingway ..... F16B 37/0842 24/291
9,033,378 B2 * 5/2015 Jenkins ..... E05C 19/184 292/256.71
2004/0060241 A1 * 4/2004 Staples ..... E06B 7/28 49/380
2004/0141828 A1 * 7/2004 Kanie ..... F16B 37/0842 411/437

(Continued)

FOREIGN PATENT DOCUMENTS

CA 2952363 A1 * 7/2017 ..... E04F 21/0023

*Primary Examiner* — Jerry E Redman
(74) *Attorney, Agent, or Firm* — The Dobrusin Law Firm, P.C.

(57) ABSTRACT

An accessory for preventing a pre-hung door from sagging in a door frame comprised of a retainer for supporting one side of the door on a lock jamb of the frame and a bolt which is slideable in the frame for preventing the door from rotating in the frame. The retainer has a "U" shaped portion which receives a lock jamb and an adjoining cylindrical portion which engages a bore in a door. The bolt is an elongated slender member having an enlarged end portion which engages a pocket in the lock jamb and a spur which resists a withdrawal of the bolt from the lock jamb.

20 Claims, 3 Drawing Sheets

(56) References Cited

U.S. PATENT DOCUMENTS

| | | | | |
|---|---|---|---|---|
| 2004/0141829 | A1* | 7/2004 | Maruyama | F16B 5/0208 411/437 |
| 2005/0102906 | A1* | 5/2005 | Massey | E05B 17/0012 49/380 |
| 2005/0135901 | A1* | 6/2005 | Reindl | F16L 337/0864 411/433 |
| 2005/0284091 | A1* | 12/2005 | Sales | E05B 17/0012 52/745.15 |
| 2006/0006675 | A1* | 1/2006 | Hendricks | E05B 17/0012 292/288 |
| 2009/0140530 | A1* | 6/2009 | LePage | E05B 17/0012 292/38 |
| 2016/0145028 | A1* | 5/2016 | Kelley | E04F 21/0007 49/380 |

* cited by examiner

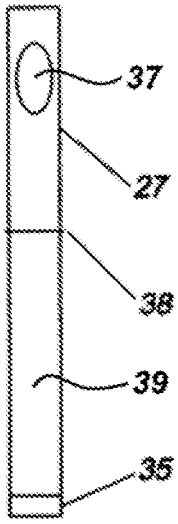
FIG. 8
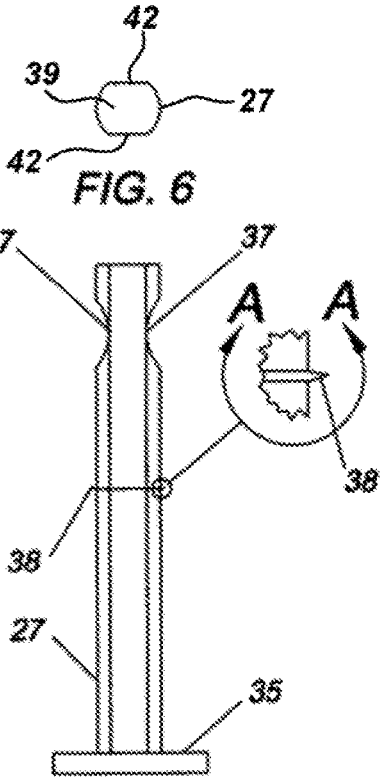
FIG. 6
FIG. 5
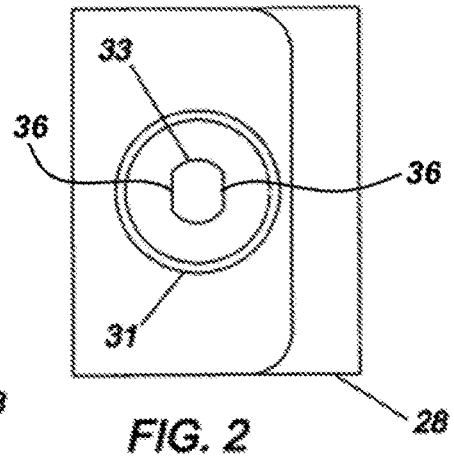
FIG. 2
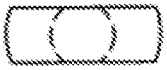
FIG. 7
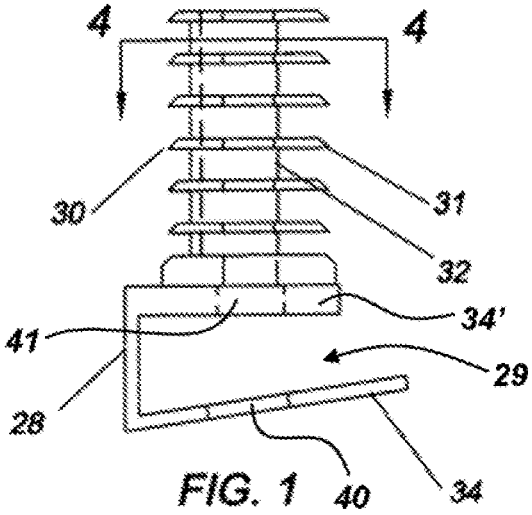
FIG. 1
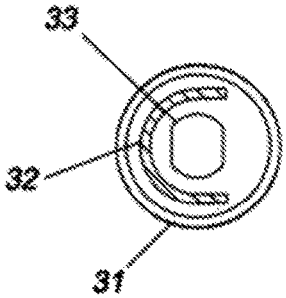
FIG. 4
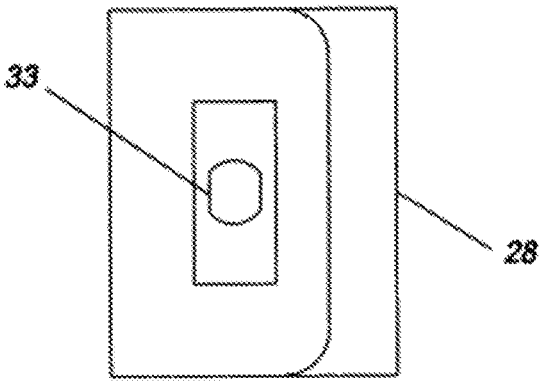
FIG. 3

ACCESSORY FOR PREVENTING A PRE-HUNG DOOR FROM SAGGING IN A DOOR FRAME

FIELD OF THE INVENTION

This invention relates to door accessories and more particularly to an accessory for preventing a pre-hung door from sagging in a door frame.

BACKGROUND OF THE INVENTION

It is a common practice to market a pre-hung door in a door frame consisting of jambs and header panels. Only one side of the door is supported on a hinge jamb with a pair of hinges. The pre-hung door is commonly closed with staples and/or adhesive tape. One problem with the current practice is that the pre-hung door tends to sag in the frame because the opposite lock side of the door is unsupported . Another problem is that tapes and staples can mar the appearance of the door.

SUMMARY OF THE INVENTION

The present invention overcomes door sag by supporting doors on opposite sides to hinge and lock jambs. The lock side is supported on the lock jamb with a retainer and a bolt. The bolt engages the lock jamb and a spur on the bolt prevents the bolt from being easily withdrawn from the jamb. One feature of the invention is changes are not required to doors or jambs.

BRIEF DESCRIPTION OF THE DRAWINGS

FIG. 1 is a plan view of a retainer for preventing a pre-hung door from sagging in a door frame.

FIG. 2 is a rear view of the retainer.

FIG. 3 is a front view of the retainer.

FIG. 4 is a cross-sectional view taken on the line 4-4 in FIG. 1.

FIG. 5 is a plan view of a bolt which is used with the retainer.

FIG. 6 is a rear view of the bolt.

FIG. 7 is a front view of the bolt.

FIG. 8 is a left side view of the bolt.

DETAILED DESCRIPTION OF A PREFERRED EMBODIMENT

Figure 11:
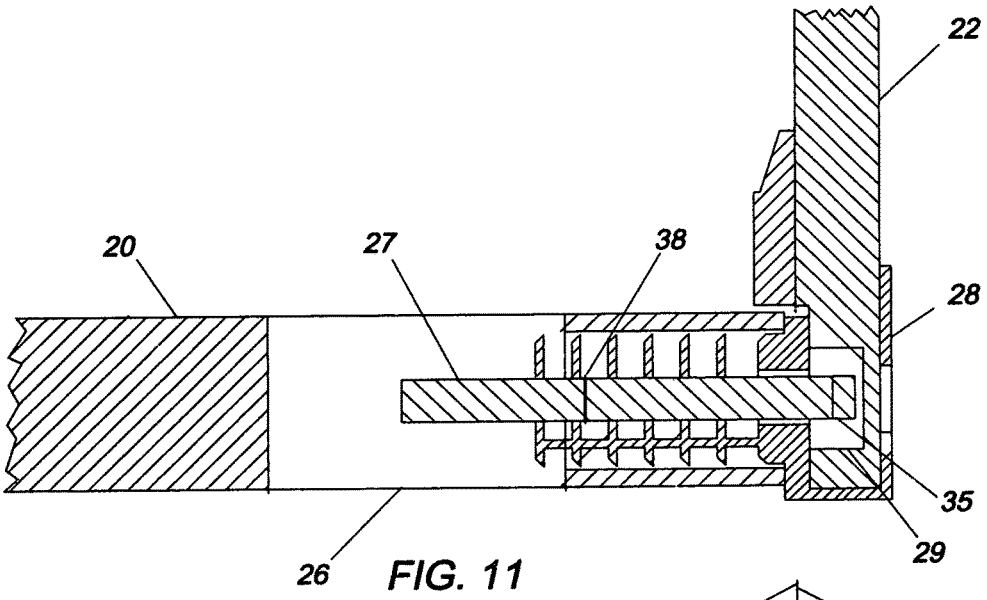
FIG. 11 is a cross-sectional view taken on the line 11-11 in FIG. 10.
Figure 10:
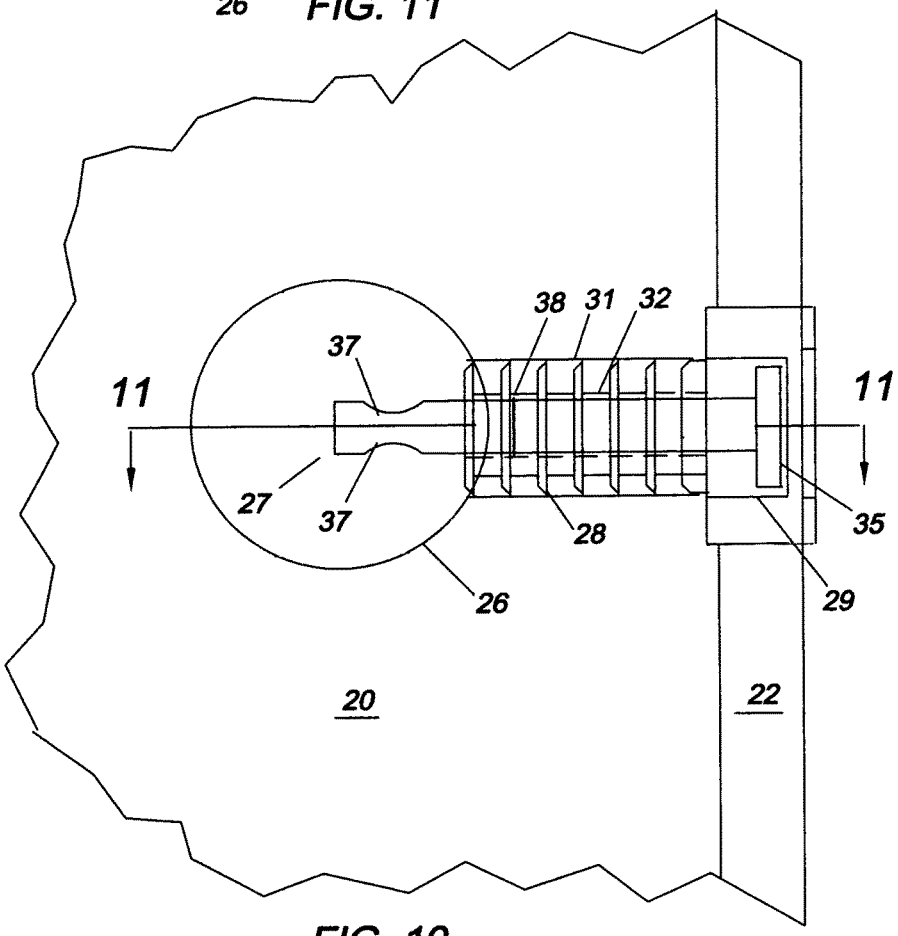
FIG. 10 is a fragmentary view of a door and jamb in according to the invention.

Referring now to the drawings wherein like numerals designate like and corresponding views throughout the several views, In FIGS. 10 and 11, a door 20 is shown mounted in a frame 21 according to the invention. The door 20 and frame 21 are conventional. On one side of a lock jamb 22 is a depression 23 for a lock strike plate (not shown). Extending into the strike plate depression 23 is a pocket 24 for a lock strike (not shown). A pair of intersecting bores 25, 26 are in the door 20 for a door lock (not shown). The door is connected as shown in FIGS. 10 and 11 to the lock jamb 22 with a bolt 27 and a retainer 28. The opposite side of the door (not shown) is connected to a hinge jamb with a pair of hinges. The bolt 27 and retainer 28 are preferably molded plastic parts.

The details of the bolt 27 and retainer 28 are shown in FIGS. 1 to 8. The retainer 28 has a "U" shaped portion 29 and an adjoining cylindrical portion 30. The cylindrical portion 30 is divided into a series of circular ribs 31 and connecting portions 32 to reduce the amount of plastic. In each of the ribs 31 is an aperture 33 which receives the bolt 27. The aperture 33 is asymmetrical to prevent the bolt 27 from rotating in the retainer 28. The aperture 33 is oval shaped and has opposing planar surface 36. The "U" shaped portion 29 has two opposing legs 34 and 34'. One leg 34 of the "U" shaped portion 29 is inclined or canted relative to the other leg 34' as will be shown to tightly retain the retainer 28 on the lock jamb 22. The two opposing leg 34, 34' are configured to sandwich the lock jamb 22 therebetween.

With reference to FIGS. 4 through 8, the bolt 27 is a slender elongated cylindrical member with an enlarged end portion 35. As shown in FIG. 6, the cross-section of the elongated body portion 39 of the bolt 27 has an oval cross section and has opposing planar surfaces 42. The cross-section of the elongated body portion 39 of the bolt 27 matches the aperture 33 in the ribs 31 of the retainer 28. At one end portion of the bolt 27 are a pair of finger depressions 37 which are used for moving the bolt 27 in the retainer 28. Referring to FIG. 5, on the circumference of the bolt 27 there is a spur 38 which as will be shown resists a withdrawal of said bolt from the lock jamb 22. The spur 38 is located between the depression 37 and the enlarged end portion 35 along a length of the bolt 27. An enlarged view of the spur 38 is shown in circle A-A.

Figure 9:
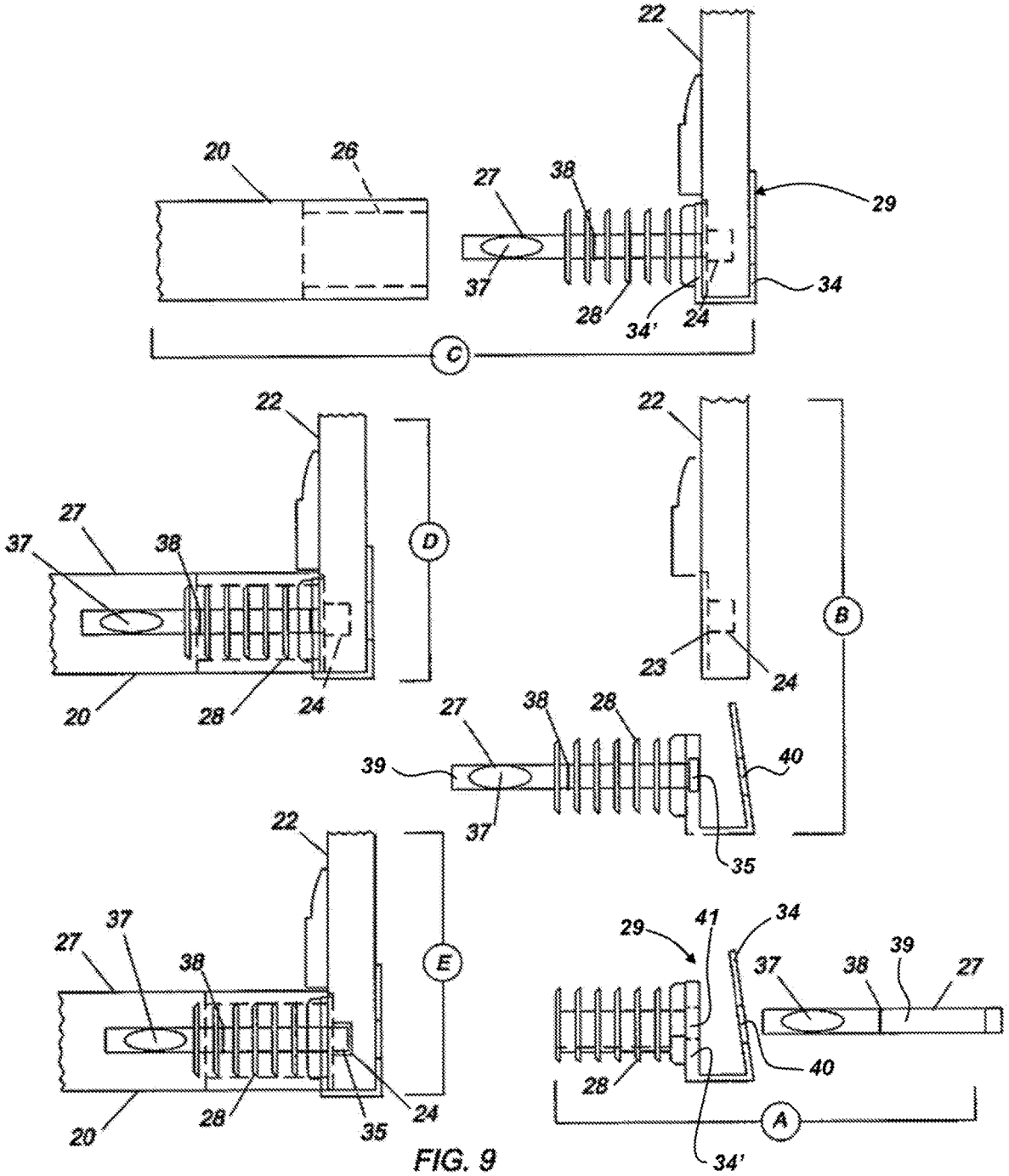
FIG. 9 shows the steps for using the invention.

The method of using the invention is shown in FIG. 9. The first step (step "A") consists of installing the bolt 27 in the retainer 28. The bolt 27 is forced into one end of the retainer 28 as shown in FIG. 9. More specifically, the elongated body portion 39 of the bolt 27 is received through an opening 40 defined in leg 34 and another opening 41 defined in leg 34'. As will be shown, the spur 38 resists the bolt 27 from being withdrawn from the lock jamb 22. Note: The spur 38 is compressed during the forcible insertion of the bolt 27 into the retainer 28. The next step (step "B") is to align the retainer 28 with the strike plate depression 23 and install the retainer 28 in the lock jamb 22 .

The third step (step "C") is to align the retainer 28 with bore 26 in the end of the door 20. The fourth step (step "D") is to install the retainer 28 in the door 20. The final step is to grasp the bolt 27 with the finger depressions 37 and move toward the lock jamb 22 to engage the enlarged end 35 of the bolt 27 with the pocket 24 in the lock jamb 22.

From the above it is apparent that what I have invention is a means for preventing sag of pre-hung doors that is non-obvious, effective and easy to use. Although only a single embodiment has been illustrated and described, it is obvious that other embodiments can be developed from my disclosure by mere changes in features such as materials, shape, omissions and substitution of parts that are known and obvious to ordinary persons skilled in the art.

What I claim is new is:

1. An accessory for preventing a pre-hung door from sagging in a door frame, the door frame having a lock jamb that includes a pocket, the pre-bung door having an aperture, the accessory comprising:

a bolt having an elongated body portion, and having an enlarged end portion for engaging the pocket in the lock jamb of the door frame; and a retainer having a U-shaped portion comprising two opposing legs configured to sandwich the lock jamb therebetween, the retainer having an adjoining cylindrical portion configured to engage the aperture defined in the pre-hung door, wherein one or both of the opposing legs comprise an opening through which the elongated body portion is configured to be received.

2. The accessory recited in claim wherein the cylindrical portion comprises an aperture configured to receive the elongated body portion of the bolt.

3. The accessory recited in claim 2, wherein the bolt comprises a spur on the elongated body portion for resisting a withdrawal of the bolt from the aperture of the cylindrical portion of the retainer.

4. The accessory recited in claim 2, wherein the cylindrical portion of the retainer comprises a plurality of ribs disposed around the aperture.

5. The accessory recited in claim 2, wherein the aperture of the cylindrical portion is oval-shaped.

6. The accessory recited in claim 1, wherein one of the opposing legs is canted relative to the other of the opposing legs.

7. The accessory recited in claim 6, wherein the canted leg comprises the opening through which the elongated body portion of the bolt is received.

8. The accessory recited in claim 1, wherein the elongated body portion of the bolt comprises an oval cross section.

9. The accessory recited in claim 1, wherein the elongated body portion of the bolt comprises a depression at an end of the bolt that opposes the enlarged end portion.

10. The accessory recited in claim 9, wherein the elongated body portion of the bolt comprises a spur located between the depression and the enlarged end portion.

11. An accessory for securing a pre-hung door in a door frame, the door frame having a lock jamb, the accessory comprising:

a bolt having an elongated body portion, and having an enlarged end portion configured to engage the lock jamb of the door frame; and a U-shaped retainer comprising tow opposing legs that are configured to sandwich the lock jamb therebetween, the retainer also having a cylindrical portion having an aperture configured to received the elongated body portion of the bolt, wherein one or both of the two opposing legs comprise an opening through which the elongated body portion of the bolt is received.

12. The accessory as recited in claim 11, Wherein one of the opposing legs is canted towards the other of the opposing legs.

13. The accessory as recited in claim 11, wherein the elongated body portion comprises a depression at an end that opposes the enlarged end portion.

14. The accessory as recited in claim 11, wherein the elongated body portion comprises a spur.

15. The accessory as recited in claim 14, wherein the spur is disposed between the depression and the enlarged end portion.

16. An accessory for preventing a pre-hung door from sagging in a door frame, the door frame having a lock jamb, the accessory comprising:

a bolt having an elongated body portion; and a retainer having two opposing legs, the lock jamb is configured to be received between the two opposing legs, the retainer having an adjoining portion that includes an aperture configured to receive the elongated body portion of the bolt, wherein one or both of the opposing legs comprise an opening through which the elongated body portion of the bolt is configured to be received.

17. The accessory as recited in claim 16, wherein one of the opposing legs is at an incline relative to the other of the opposing legs.

18. The accessory as recited in claim 16, wherein the bolt has an end portion that is configured to engage a pocket of the lock jamb of the door frame.

19. The accessory as recited in claim 18, wherein the end portion is enlarged relative to the body portion.

20. The accessory as recited in claim 16, wherein the bolt comprises finger depressions.

* * * * *